United States Patent [19]

Nakano

[11] Patent Number: 4,913,025

[45] Date of Patent: Apr. 3, 1990

[54] APPARATUS FOR CONTROLLING SOUND VOLUME OF ELECTRONIC MUSICAL INSTRUMENT

[75] Inventor: Yoshinobu Nakano, Hamamatsu, Japan

[73] Assignee: Kabushiki Kaisha Kawai Gakki Seisakusho, Shizuoka, Japan

[21] Appl. No.: 151,518

[22] Filed: Feb. 2, 1988

[51] Int. Cl.[4] ..... G10H 1/46

[52] U.S. Cl. ..... 84/711; 84/477 R; 381/109

[58] Field of Search ..... 84/477 R, 478, 1.28, 84/1.27, 1.01, DIG. 7, 1.09, 1.1; 340/753, 365 S; 381/104, 107, 109; 307/113; 341/20, 22, 31-34; 455/200, 219, 232, 233, 355

[56] References Cited

U.S. PATENT DOCUMENTS

| | | | |
|---|---|---|---|
| 4,121,204 | 10/1978 | Welch et al. | 340/753 X |
| 4,247,855 | 1/1981 | Uede et al. | 340/753 |
| 4,333,376 | 6/1982 | Moore et al. | 84/1.27 |
| 4,386,347 | 5/1983 | Cutler et al. | 340/753 X |
| 4,631,525 | 12/1986 | Serravalle, Jr. | 340/365 S |
| 4,694,725 | 9/1987 | Seevers et al. | 84/1.27 |
| 4,699,038 | 10/1987 | Wedge | 84/1.1 |
| 4,706,294 | 11/1987 | Ouchida | 381/109 |

FOREIGN PATENT DOCUMENTS

| | | | |
|---|---|---|---|
| 0127524 | 8/1986 | Japan . | |
| 2133164 | 7/1984 | United Kingdom | 84/1.01 |

*Primary Examiner*—Stanley J. Witkowski
*Attorney, Agent, or Firm*—Michael N. Meller

[57] ABSTRACT

An apparatus for controlling the sound volume of an electronic musical instrument has a row of volume select depress switches. In response to depression of any one switch, a corresponding sound volume is produced. The sould volume increases for each successive switch along the row. If two successive switches are depressed simultaneously, a sound volume is produced which is intermediate the sound volume produced by depression of one switch only and the sound volume produced by depression of the adjacent switch only. A corresponding row of volume indicators is provided. In response to depression of one of the switches, the volume indicator corresponding to the sound volume of the depressed switch and all of the volume indicators corresponding to the not depressed switches having a sound volume less than that of the depressed switch are activated.

8 Claims, 6 Drawing Sheets

PRIOR ART

APPARATUS FOR CONTROLLING SOUND VOLUME OF ELECTRONIC MUSICAL INSTRUMENT

FIELD OF THE INVENTION

The present invention relates to an apparatus for controlling the sound volume of an electronic musical instrument such as an electronic organ.

BACKGROUND OF THE INVENTION

In recent years, electronic organs have generally been equipped with a memory function which enables the tone color and sound volume to be set and stored, and enables the thus set tone color and sound volume to be recalled by one-touch operation.

FIGS. 8A and 8B illustrate a conventional volume control apparatus used with electronic organs, including an operator frame 40 which is an apparatus body. The operator frame 40 has, for example, five through holes 44 in which will be inserted depress operation members 42*a* of a volume select switch 42 and five through holes for illumination portions of lenses 48 of light-emitting diodes 46 to indicate the volume. A printed board 52 having the light-emitting diode 46 and a switch body 42*b* of the switch 42 mounted thereon is arranged under the depress operation members 42*a* and lenses 48.

There has also been widely known a volume control apparatus which consists of a slide volume control that can be moved both by hand and motor, and in which a knob represents an indication position.

According to the conventional apparatus mentioned above, when five switches 42 are arranged, the sound volume can be changed in five steps only. Further, the switch 42 that must be depressed cannot offer the smooth operation feeling provided by a slide volume control. As for the indication of volume, only one light-emitting diode 46 corresponding to a given volume level is turned on to indicate the volume level, so that the volume level is not readily recognizable from the position of the switch 42 unless the indication therefor on the apparatus body is read. This is not advantageous from the standpoint of playing music.

According to the conventional apparatus in which the volume can be changed continuously by a slide volume control, the mechanism is so complex as to result in a higher manufacturing cost and be more liable to become defective.

BRIEF SUMMARY OF THE INVENTION

The object of the present invention is to provide an apparatus for controlling the sound volume of an electronic musical instrument which is capable of eliminating the aforementioned disadvantages.

In order to achieve the afore-mentioned object, in accordance with the invention an apparatus is provided for controlling the sound volume of an electronic musical instrument in which the magnitude of scale sound signals is controlled by a volume control signal obtained through operation of a volume select switch, and a volume indicator that corresponds to the sound volume is then actuated thereby. A plurality of volume select depress switches are arranged in a line in an apparatus body, each of the depress switches having an operation member with the upper end being so formed as to have an arcuate surface and so disposed as to protrude slightly beyond the surface of the apparatus body. A plurality of volume indicator devices are arranged in a line so as to correspond respectively to the plurality of switches. A means is provided which, in response to operation of any one of the depress switches, produces a volume control signal that corresponds to the operated switch. A means is also provided which, when two of the depress switches are depressed simultaneously, produces a volume control signal that corresponds to the medium level of the sound volume of the respective depressed switches. Finally, a means is provided which, in response to operation of one of the depress switches, produces signals for actuating not only a volume indicator device that corresponds to a sound volume of the depressed switch but also all of those volume indicator devices corresponding to sound volumes smaller than that of the depressed switch.

A player moves his finger along the surface of an apparatus body just like moving a slide volume control and depresses one of the volume select depress switches or a plurality of the volume select depress switches successively. Then, a volume control signal of the sound volume corresponding to the depressed switch is produced, or volume control signals of a plurality of sound volumes corresponding to the plurality of depressed switches are successively produced, whereby a scale sound of the sound volume corresponding to the depressed switch is emitted in response to the volume control signal or scale sounds of a plurality of sound volumes corresponding to the plurality of depressed switches are successively emitted. At the same time, volume indicator devices corresponding to, and smaller than, the sound volume of the switch depressed are all actuated by the operation of the switch, or the volume indicator devices corresponding to, and smaller than the sound volumes of the switches depressed are all actuated as said plurality of the switches are successively operated.

When two of the depress switches are operated, a volume control signal is produced that corresponds to a volume level intermediate between the sound volumes of the two switches, so that a scale sound of a volume intermediate between the volumes of the two switches is produced in response to said signal.

Thus, according to this invention, there can be obtained twice as many volume change steps as the number of the volume select switches provided by operating one or two of the switches at a time.

It also enables a selected volume to be recognized at a glance from the number of the volume indicator devices actuated.

BRIEF DESCRIPTION OF THE DRAWINGS

The preferred embodiments of the invention will be described in detail hereinafter with reference to the drawings, wherein.

DETAILED DESCRIPTION OF THE PREFERRED EMBODIMENTS

Figure 1:
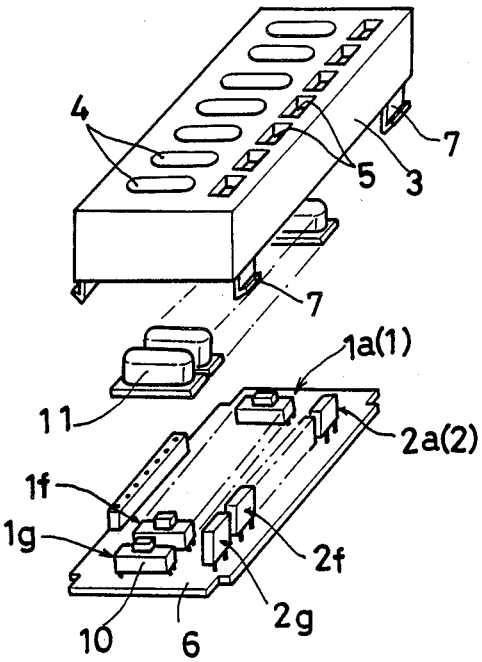
FIG. 1 is a perspective view which illustrates an embodiment of the present invention in a disassembled state.
Figure 3:
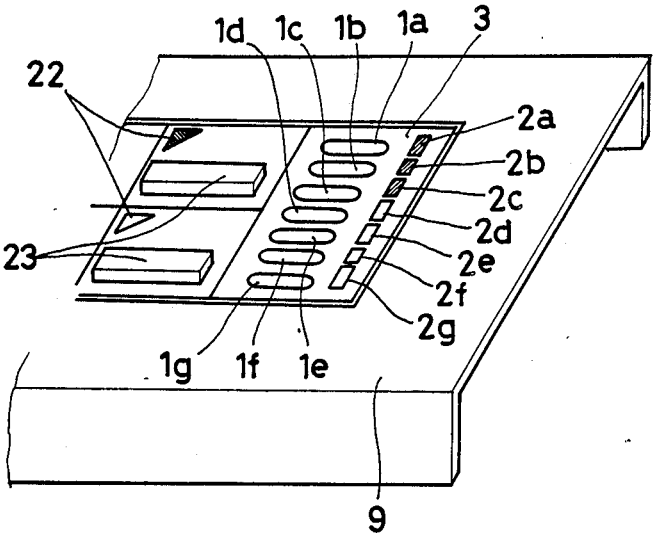
FIG. 3 is a perspective view illustrating the embodiment of FIG. 1 when mounted on the panel of an electronic musical instrument together with the tone color changing switch.
Figure 2A:
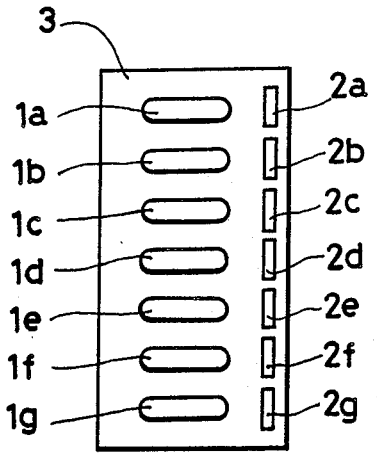
FIG. 2(A) is a front view of the embodiment shown in FIG. 1.

In FIGS. 1 to 3, a volume select depress switch assembly comprises switch bodies 10 and operation members 11. Reference numeral 2 denotes a light-emitting diode (volume indicator device), and reference numeral 3 denotes a case (apparatus body) having, for example, a first plurality of through holes 4 arranged in a row and a second plurality of through holes 5 arranged in a row. The operation members 11 of the switch assembly are respectively inserted in through holes 4 and the light-emitting diodes 2 are respectively inserted in through holes 5.

The switch assembly has seven switches 1*a*, 1*b*, . . . , 1*g* for selecting sound volumes in seven steps from a small volume to a large volume, as well as seven volume indicator devices 2*a*–2*g* that correspond to the seven switches 1*a*–1*g*.

The switch bodies 10 of the switch assembly, i.e., of the seven switches 1*a*–1*g*, have metal contacts that are available in the market and offer click feeling with a displacement of 0.2–0.3 mm. Namely, switch units called mechanical tact switches are used in which the moving contacts come into contact with the fixed contacts when the caps are depressed. When a printed board 6 is mounted in the case 3, the switch bodies 10 are arranged on the printed board 6 so as to correspond to the seven operation members 11 that are respectively inserted in the through holes 4 of the case 3. Likewise, the seven light-emitting diodes 2*a*–2*g* are arranged on the printed board 6 so as to be respectively inserted in the through holes 5 of the case 3.

Figure 2B:
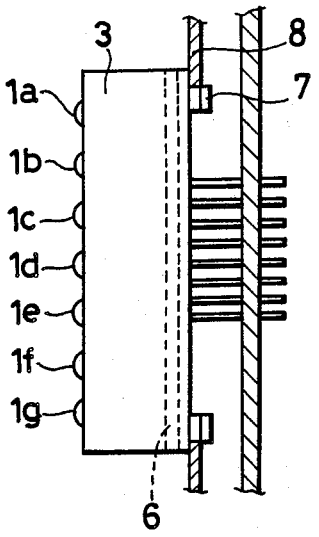
FIG. 2(B) is a side view of the embodiment shown in FIG. 1.

Upper surfaces of the operation members 11 are formed in an arcuate shape, and the operation members 11 are respectively inserted in the through holes 4 of the case 3 in such a manner that the upper ends slightly protrude (e.g., by about 0.8 mm) beyond the surface of the case 3. When a finger is slid along the surface of the case 3 as shown in FIG. 2(B), the finger can be placed on any operation member 11 with relatively small resistance to depress it. In other words, the switch offers the operative feeling of a slide volume control. The operation members 11 are 2 mm wide and 9 mm long, and are arranged to be spaced, for example, 5 mm from each other so that any two neighboring operation members 11 can be depressed simultaneously.

Figure 2C:
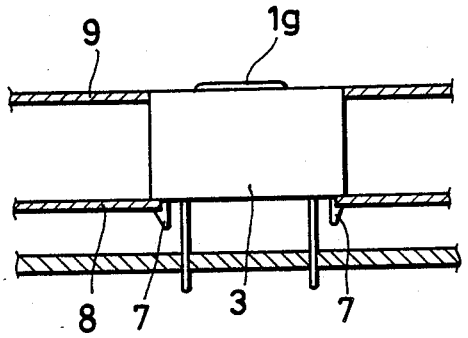
FIG. 2(C) is a bottom view of the embodiment shown in FIG. 1.

The case 3 provided with the switch assembly and the light-emitting diodes 2*a*–2*g* is attached to a chassis 8 by snap-in stoppers 7 planted in the lower portions thereof, and is mounted on a panel of the electronic musical instrument as shown in FIG. 2(C) and FIG. 3.

In FIG. 3, tone color changing switches 23 are mounted on the panel 9. Indicators 22 will be turned on when the tone color changing switches 23 are operated. FIG. 3 illustrates the state where one tone color changing switch 23 and one switch 1*c* are operated.

Figure 4:
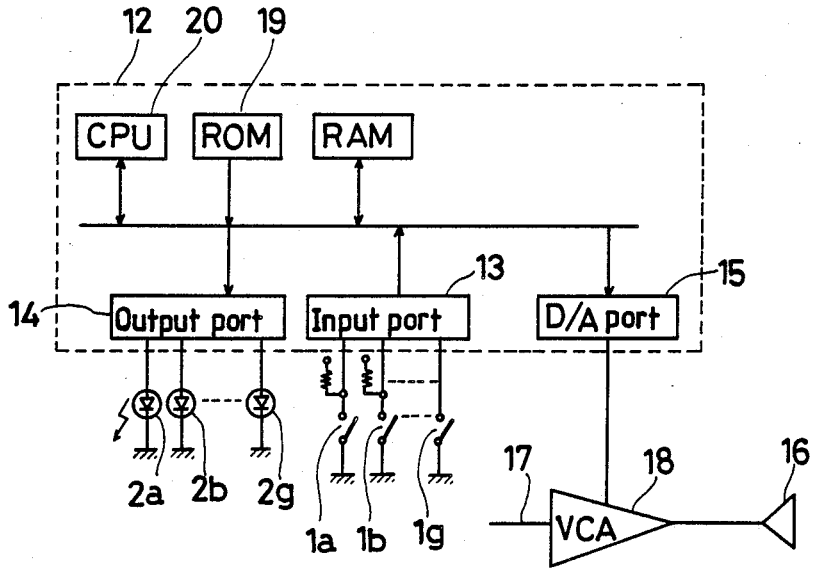
FIG. 4 is a block diagram illustrating the circuit structure of the embodiment of FIG. 1.

FIG. 4 is a block diagram of the circuitry of the first preferred embodiment of the invention. A computer 12 includes an input port 13 and an output port 14 to which the switches 1*a*–1*g* and the light-emitting diodes 2*a*–2*g* are respectively connected. The computer 12 further includes a digital-to-analog (D/A) port 15 to which is connected a control electrode of a voltage-controlled amplifier (VCA) 18 interposed in a scale sound signal passage circuit 17 that connects the sound source (not shown) to a loudspeaker 16.

ROM 19 of the computer 12 stores output values (volume control signals) of the D/A port 15 corresponding to the switches 1*a*–1*g* and turn-on signals that will be inputted to the light-emitting diodes 2*a*–2*g* in a manner as tabulated below.

TABLE

| Switch | D/A output | 2g | 2f | 2e | 2d | 2c | 2b | 2a |
|---|---|---|---|---|---|---|---|---|
| 1a | 10 | 0 | 0 | 0 | 0 | 0 | 0 | 1 |
| | 15 | 0 | 0 | 0 | 0 | 0 | 0 | 1 |
| 1b | 20 | 0 | 0 | 0 | 0 | 0 | 1 | 1 |
| | 25 | 0 | 0 | 0 | 0 | 0 | 1 | 1 |
| 1c | 30 | 0 | 0 | 0 | 0 | 1 | 1 | 1 |
| | 35 | 0 | 0 | 0 | 0 | 1 | 1 | 1 |
| 1d | 40 | 0 | 0 | 0 | 1 | 1 | 1 | 1 |
| | 45 | 0 | 0 | 0 | 1 | 1 | 1 | 1 |
| 1e | 50 | 0 | 0 | 1 | 1 | 1 | 1 | 1 |
| | 55 | 0 | 0 | 1 | 1 | 1 | 1 | 1 |
| 1f | 60 | 0 | 1 | 1 | 1 | 1 | 1 | 1 |
| | 65 | 0 | 1 | 1 | 1 | 1 | 1 | 1 |
| 1g | 70 | 1 | 1 | 1 | 1 | 1 | 1 | 1 |

For example, in ROM 19 are stored an output value "10" of D/A port 15 and a turn-on signal "1" of the light-emitting diode 2*a* that are read out in response to the operation of the switch 1*a*, an output value "20" of D/A port 15 and turn-on signals "1" of the light-emitting diodes 2*a* and 2*b* that are read out in response to the operation of the switch 1*b*, and an output value "15" of D/A port 15 and a turn-on signal "1" of the light-emitting diode 2*a* that are read out in response to the simultaneous operation of the switches 1*a* and 1*b*.

Next, operation of the circuit of FIG. 4 will be described.

If the switch 1*a* is depressed to select the smallest sound volume, the CPU 20 receives the switch data through the input port 13 (step 31 in FIG. 5) and determines whether the switch 1*a* is operated or not (step 32). When it is determined that the switch 1*a* is operated, a volume control signal of the output value "10" of D/A port 15 and a turn-on signal for the light-emitting diode 2*a* are read out from the ROM 19 (step 34) via step 33. The volume control signal of the output value "10" of D/A port 15 is output from the D/A port 15 via step 35 to control the VCA 18. Thus, a scale sound of a small volume corresponding to the D/A output value "10" is emitted from the loudspeaker 16. At this moment, a turn-on signal is produced from the output port 14 to the light-emitting diode 2*a* (step 36) to turn on the light-emitting diode 2*a*.

Figure 5:
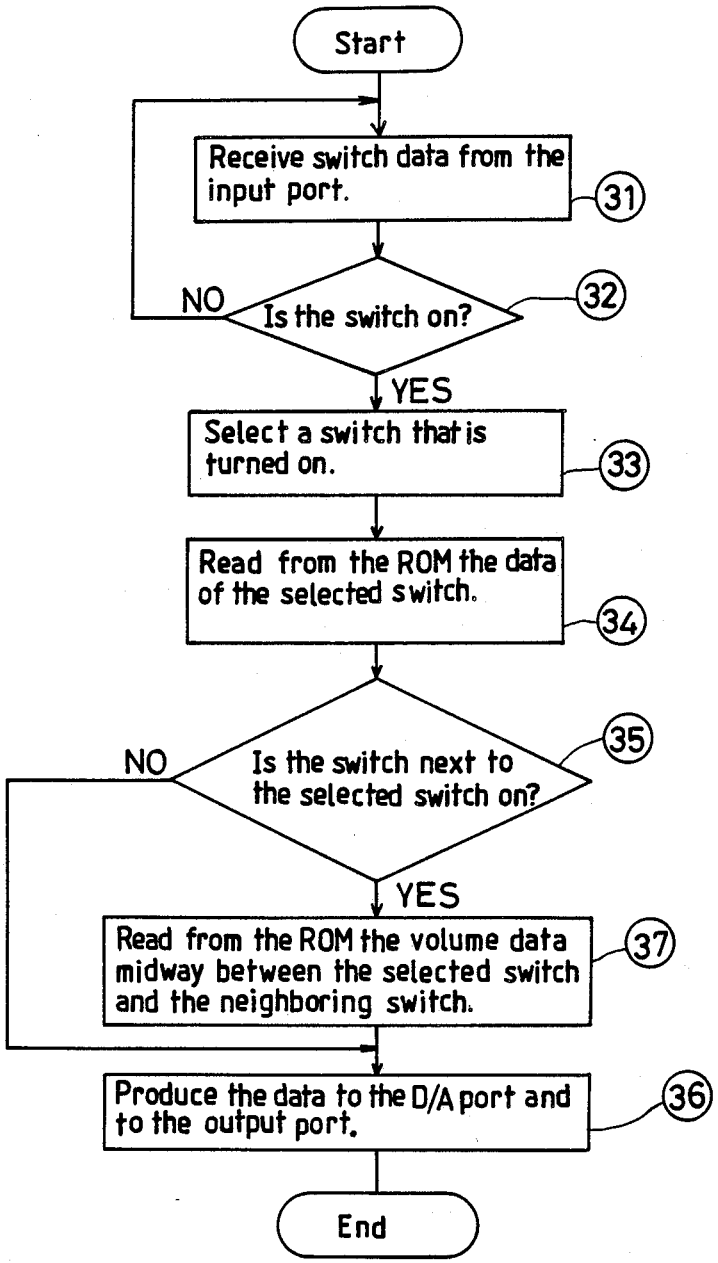
FIG. 5 is a flowchart illustrating the operation of the present invention.

When one of the other switches 1*b* to 1*g* is depressed, the scale sound of volume corresponding to the depressed switch is transmitted from the loudspeaker 16 after going through the same steps as above, in which case two or more of the light-emitting diodes 1*a* to 1*g* are turned on. Next, when the switch 1*a* for selecting the smallest volume and the switch 1*b* for selecting the next smallest volume are simultaneously depressed, the CPU 20 receives the two switch data from the input port 13 (step 31) as illustrated in FIG. 5 and determines whether the switches 1*a* and 1*b* are operated or not (step 32). When it is determined that both switches 1*a* and 1*b* are operated, the switch 1*a* of a smaller volume is selected first (step 33) and a volume control signal of the D/A output value "10" corresponding to the switch 1*a* and a turn-on signal for the light-emitting diode 2*a* are read out from the ROM 19 (step 34). Next, it is determined whether or not the switch 1*b* next to the switch 1*a* is operated (step 35). When the switch 1*b* is determined to have been operated, a volume control signal of a D/A output value "15" corresponding to a volume level intermediate between those of the switches 1*a* and 1*b* is read out from ROM 19 (step 37). The volume control signal of the D/A output value "15" read out from the ROM 19 is output from the D/A port to control the VCA 18 while the turn-on signal for the light-emitting diode 2*a* is output from the output port 14 to the light-emitting diode 2*a*. Thus, a scale sound of a volume corresponding to the D/A port output value "15" is transmitted from the loudspeaker 16 and the light-emitting diode 2*a* is turned on.

When two of the other switches 1*c* to 1*g* are simultaneously depressed, the scale sound signal of a volume level intermediate between the separate volume levels of the two switches depressed is transmitted from the loudspeaker 16, and light-emitting diodes corresponding to the smaller volume switch of the two and to those switches which produce a volume less than said smaller volume switch are all turned on.

Figure 6:
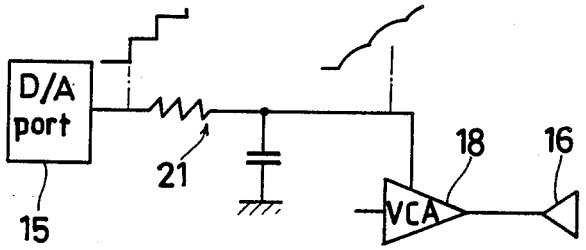
FIG. 6 is a circuit diagram illustrating a major portion according to another embodiment of the present invention.
Figure 7A:
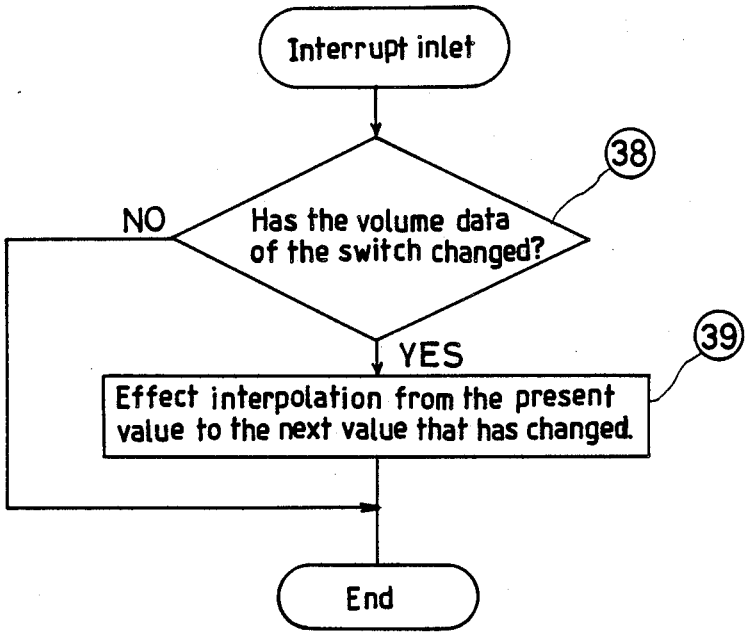
FIG. 7(A) is a flowchart illustrating the operation of the portion shown in FIG. 6.
Figure 7B:
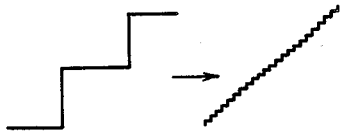
FIG. 7(B) is a diagram of waveforms of a voice control signal obtained through the steps of the flowchart of FIG. 7(A)
Figure 8A:
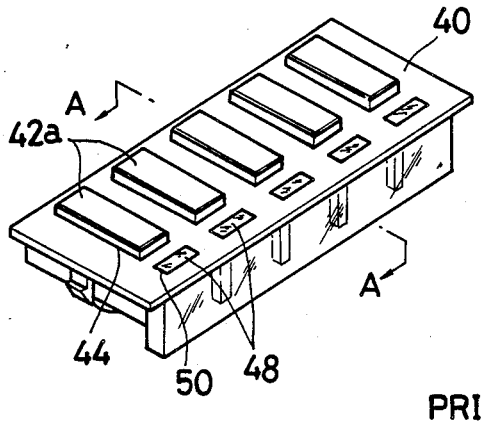
FIG. 8(A) is a perspective view showing a conventional volume control apparatus.
Figure 8B:
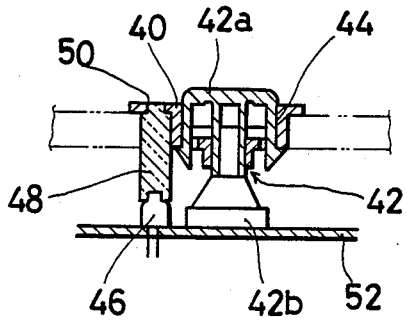
PRIOR ART FIG. 8(B)
FIG. 8(B) is a sectional view taken along the line A—A of FIG. 8(A).

When noise is easily generated in the circuit of FIG. 4, an integration circuit 21 is inserted in a connection circuit that connects the D/A port 15 and the VCA 18 together as shown in FIG. 6, or the interrupt processing is effected in the flow of computer 12 as illustrated in FIG. 7(*a*) so smoothen the step change of the volume control signal, thereby supressing the noise. When the interrupt processing is executed, it is determined in step 38 whether the output to the D/A port 15 is changed. When the output is changed, interpolation is effected from the present value to a next value (step 39) to make the change smooth as shown in FIG. 7(B).

According to the present invention as described above, volume is selected with the same operation feeling as that of a slide volume control. Furthermore, the volume can be varied in twice as many steps as the number of volume select switches, and the magnitude of the selected sound volume can be learned directly from the number of volume indicator devices turned on, thus facilitating the play of an electronic musical instrument. In addition the apparatus seldom becomes defective and can be maufactured at a reduced cost.

What is claimed is:

1. In an apparatus for controlling the sound volume of an electronic musical instrument in which the amplitude of a sound signal is controlled by a volume control signal obtained through operation of at least one depressible volume selection switch, and a volume indicator device that corresponds to the sound volume is then acutated thereby, the improvement which comprises:

first and second depressible volume selection switches which are arranged adjacent to each other in an apparatus body, each of said volume selection switches having an operation member with an upper end being so formed as to have an arcuate surface and so disposed as to be slightly protruding beyond a surface of said apparatus body;

means for producing a first volume control signal that corresponds to a first sound volume in response to depression of said first volume selection switch alone;

means for producing a second volume control signal that corresponds to a second sound volume different than said first sound volume in response to depression of said second volume selection switch alone; and means for producing a third volume control signal, in response to simultaneous depression of said first and second volume selection switches, that corresponds to a sound volume intermediate said first and second sound volumes.

2. The apparatus as defined in claim 1, further comprising a third depressible volume selection switch which is arranged in line with said first and second volume selection switches and adjacent to said second volume selection switch in said apparatus body, said third volume selection switch having an operation member with an upper end being so formed as to have an arcuate surface and so disposed as to be slightly protruding beyond said surface of said apparatus body;

means for producing a fourth volume control signal that corresponds to a fourth sound volume different than said first, second and third sound volumes in response to depression of said third volume selection switch alone; and means for producing a fifth volume control signal, in response to simultaneous depression of said second and third volume selection switches, that corresponds to a sound volume intermediate said second and fourth sound volumes.

3. The apparatus as defined in claim 2, further comprising first, second and third volume indicator devices so arranged in a line as to correspond respectively to said first, second and third volume selection switches; and means for producing signals in response to depression of one of said volume selection switches for actuating not only a volume indicator device that corresponds to a sound volume of a depressed switch but also all of those volume indicator devices corresponding to the undepressed switches having a sound volume less than that of said depressed switch.

4. The apparatus as defined in claim 1, further comprising digital-to-analog port means for receiving said volume control signals, voltage-controlled amplifier means for receiving voltage signals corresponding to said volume control signals from said digital-to-analog port means and a sound source signal, and sound-transmitting means for receiving amplified sound signals from said voltage-controlled amplifier means.

5. The apparatus as defined in claim 4, further comprising integrating means for coupling said voltage-controlled amplifier means to said digital-to-analog port means.

6. The apparatus as defined in claim 1, wherein said means for producing volume control signals comprise read only memory means for storing said volume control signals and central processing means for reading out a selected one of said volume control signals from said read only memory means in dependence on which of said volume selection switches have been depressed.

7. The apparatus as defined in claim 1, further comprising a third depressible volume selection switch, wherein said first, second and third volume selection switches are sequentially arranged in a row, said second volume selection switch producing a sound volume in response to depression thereof which is greater than the sound volume produced by depression of said first volume selection switch, and said third volume selection switch producing a sound volume in response to depression thereof which is greater than the sound volume produced by depression of said second volume selection switch.

8. In an apparatus for controlling the sound volume of an electronic musical instrument in which the amplitude of a sound signal is controlled by a volume control signal obtained through operation of at least one depressible volume selection switch, and a volume indicator device that corresponds to the sound volume is then actuated thereby, the improvement which comprises:

a plurality of depressible volume selection switches which are arranged in a row in an apparatus body, each of said volume selection switches having an operation member with an upper end being so formed as to have an arcuate surface and so disposed as to be slightly protruding beyond a surface of said apparatus body;

means for producing a different one of a plurality of first volume control signals in response to depression of each one of said plurality of volume selection switches alone, said first volume control signals corresponding to respective sound volumes, each volume selection switch producing a sound volume in response to depression thereof which is greater than the sound volume produced by depression of the adjacent volume selection switch arranged in a first direction along said row;

means for producing a different one of a plurality of second volume control signals in response to simultaneous depression of a respective pair of adjacent volume selection switches, said second volume control signals corresponding to respective sound volumes which are intermediate the respective sound volumes to which said first volume control signals correspond;

a plurality of volume indicator devices so arranged in a line as to correspond respectively to said plurality of volume selection switches; and means for producing signals in response to depression of one of said volume selection switches for actuating not only a volume indicator device that corresponds to a sound volume of a depressed swich but also all of those volume indicator devices corresponding to the undepressed switches having a sound volume less than that of said depressed switch, wherein said means for producing volume control signals comprise read only memory means for storing said volume control signals and central processing means for reading out a selected one of said volume control signals from said read only memory means in dependence on which of said volume selection switches have been depressed.

* * * * *

UNITED STATES PATENT AND TRADEMARK OFFICE

CERTIFICATE OF CORRECTION

PATENT NO. : 4,913,025

DATED : April 3, 1990

INVENTOR(S) : Yoshinobu Nakano

It is certified that error appears in the above-identified patent and that said Letters Patent is hereby corrected as shown below:

On the title page, add the following priority data:

--[30] Foreign Application Priority Data
Feb. 3, 1987 [JP] Japan .....62-21722--.

Signed and Sealed this

Twenty-eighth Day of May, 1991

*Attest:*

HARRY F. MANBECK, JR.

*Attesting Officer*

*Commissioner of Patents and Trademarks*